US008956175B2

(12) United States Patent
Makrinos

(10) Patent No.: US 8,956,175 B2
(45) Date of Patent: Feb. 17, 2015

(54) EXTENSION CORD RETENTION DEVICE

(71) Applicant: Stephen S. Makrinos, Garden City, NY (US)

(72) Inventor: Stephen S. Makrinos, Garden City, NY (US)

( * ) Notice: Subject to any disclaimer, the term of this patent is extended or adjusted under 35 U.S.C. 154(b) by 48 days.

(21) Appl. No.: 13/826,226

(22) Filed: Mar. 14, 2013

(65) Prior Publication Data

US 2014/0273598 A1 Sep. 18, 2014

(51) Int. Cl.
*H01R 13/639* (2006.01)

(52) U.S. Cl.
CPC ..... *H01R 13/6392* (2013.01)
USPC ..... 439/369

(58) Field of Classification Search
USPC ..... 439/369, 371, 373
See application file for complete search history.

(56) References Cited

U.S. PATENT DOCUMENTS

| | | | | |
|---|---|---|---|---|
| 3,475,716 | A | 10/1969 | Laig | |
| 3,907,239 | A * | 9/1975 | Ehrlich | 248/229.26 |
| 4,183,603 | A | 1/1980 | Donarummo | |
| D295,725 | S * | 5/1988 | Shioda | D8/396 |
| 5,167,524 | A * | 12/1992 | Falcon et al. | 439/371 |
| 5,334,042 | A * | 8/1994 | Chevalier | 439/369 |
| 5,582,524 | A | 12/1996 | Sanner et al. | |
| 5,752,848 | A * | 5/1998 | Youngmark | 439/369 |
| 6,217,366 | B1 * | 4/2001 | Weisstock | 439/369 |
| 6,319,044 | B1 * | 11/2001 | Stekelenburg | 439/369 |
| D495,999 | S * | 9/2004 | Lewis | D13/154 |
| 7,081,004 | B1 | 7/2006 | Puzio | |
| 7,316,580 | B1 * | 1/2008 | Walker | 439/369 |
| 7,425,148 | B1 | 9/2008 | Allen | |
| 7,465,182 | B1 * | 12/2008 | McDonald | 439/369 |
| D604,589 | S | 11/2009 | Johansson | |
| 7,887,360 | B2 * | 2/2011 | Andrade | 439/369 |
| 7,972,165 | B1 * | 7/2011 | Lifson | 439/369 |

* cited by examiner

*Primary Examiner* — Alexander Gilman
(74) *Attorney, Agent, or Firm* — Sorell, Lenna & Schmidt, LLP

(57) ABSTRACT

An attachable device for preventing disengagement of a male plug connected to a female plug is provided. The device includes an elongated portion having a first end with a first connector and a second end with a second connector, each connector having a cord extending therefrom and the first connector is connected to one of the cords extending from the male and female plugs and the second connector is connected to the other cord such that the device prevents disengagement of the male and female plugs when the cords are pulled in a direction away from each other.

20 Claims, 3 Drawing Sheets

EXTENSION CORD RETENTION DEVICE

BACKGROUND

The present disclosure relates to a device for preventing electrical cords in connection in series from accidental disconnecting.

It is often useful or necessary to connect an extension cord to an appliance in a home or use one or more extension cords during use of portable devices such as handheld power tools, vacuum cleaners, blowers and trimmers. When doing so, if the plug and socket combination inadvertently or accidentally disengage during use, such disconnection can cause inconvenience and down time. This is also a potential safety hazard especially if the prongs from the male plug of one cord come half way out of the female plug of another cord thereby exposing an electrically live surface. The inherent strength of the coupling brought about by the friction between the prongs of one plug on the first cord and their corresponding receptacle on the second cord generally will not hold anything but the most moderate separating tension.

Presently, to hold a pair of extension cords connected or prevent accidental disconnection thereof, individuals often tie the cords together near their ends and then plug them together. While this will generally keep the cords together, it shortens the effective length of the cords and creates a different safety hazard which is a large knot that can unexpectedly catch on a work-piece, bush, rock or other object with potentially disastrous results. This is also not safe because it can weaken or break one or both of the cords at the cord ends creating an electrical hazard. Tape has also been used to hold cords together. Although this can work to some degree, it is often messy leaving a residue of adhesive on the cords and/or plugs after the tape has been removed. A number of clips or clamps for holding electrical cord connectors together have been suggested and developed to retain two electrical cords and plugs. However, the prior art devices, typically, are often time consuming to attach and require more than one part. This makes them complicated to manufacture and difficult to use. Also, many of these devices require permanent attachment to the plugs and receptacles forcing the user to purchase multiple sets or be attached to the cords during the manufacturing stage of the cord itself. Others must be detached from the cords if not in use and therefore need to be moved from connection to connection.

Accordingly, a need exists for an efficient, inexpensive and easy-to-use device for holding together electrical cords and preventing accidental disconnection of the cords.

SUMMARY

New devices that are inexpensive to manufacture and easy-to-use for holding together electrical cords and preventing accidental disconnection of electrical cords are provided. One embodiment provides for an attachable device for preventing disengagement of a male plug connected to a female plug including an elongated portion having a first end with a first connector and a second end with a second connector. The male and female plugs each have a cord extending therefrom and the first connector is connected to one of the cords extending from the male and female plugs and the second connector is connected to the other cord such that the device prevents disengagement of the male and female plugs when the cords are pulled in a direction away from each other. The first and second connectors can each include a strap. Further, each of the first and second connectors can include an additional strap for preventing disengagement of a second male plug connected to a second female plug. The elongated portion can be tubular-shaped, cylindrically-shaped or rectangularly-shaped. In some embodiments, the elongated portion is tubular-shaped and includes holes therein for enhanced flexibility. In various embodiments, the elongated portion has a third connector at a point between the first and second connectors and the third connector is connected to one of the cords.

In another embodiment of an attachable device for preventing disengagement of a male plug connected to a female plug, a device is provided including an elongated tubular portion having a first end with a first strap and a second end with a second strap, wherein each of the male and female plugs have a cord extending therefrom and the first strap is connected to one of the cords extending from the male and female plugs and the second strap is connected to the other cord such that the device prevents disengagement of the male and female plugs when the cords are pulled in a direction away from each other. The elongated tubular portion can include holes therein for enhanced flexibility.

A method for preventing disengagement of a male plug connected to a female plug is also provided. The method provides for attaching a device having a first end with a first connector to one of the cords extending from the male and female plugs and then attaching a second end with a second connector of the device to the other cord extending from the male and female plugs such that the device prevents disengagement of the male and female plugs when the cords are pulled in a direction away from each other. The first and second connectors can each include a strap. Further, each of the first and second connectors can include an additional strap for preventing disengagement of a second male plug connected to a second female plug. The device can be in the shape of an elongated tube, an elongated cylinder, an elongated rectangle or a flat and thin wire. In some embodiments, the device is tubular-shaped and includes holes therein for enhanced flexibility. In various embodiments, the device has a third connector at a point between the first and second connectors and the third connector is connected to one of the cords.

In various embodiments, the straps include a Velcro-type fastener and/or a snap-button fastener. The additional straps in various embodiments include a Velcro-type fastener and/or a snap-button fastener.

In various embodiments, the elongated portion or device includes a material that is not stretchable or substantially non-stretchable such as one or more of plastic, wood, metal, etc. In some embodiments, the elongated portion or device includes a material that is substantially non-stretchable yet flexible. The material may also have holes therein to enhance flexibility.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description and appended claims.

BRIEF DESCRIPTION OF THE DRAWINGS

In part, other aspects, features, benefits and advantages of the embodiments will be apparent with regard to the following description, appended claims and accompanying drawings where:

It is to be understood that the figures are not drawn to scale. Further, the relation between objects in a figure may not be to scale, and may in fact have a reverse relationship as to size. The figures are intended to bring understanding and clarity to the structure of each object shown, and thus, some features may be exaggerated in order to illustrate a specific feature of a structure.

DETAILED DESCRIPTION

For the purposes of this specification and appended claims, unless otherwise indicated, all numbers expressing quantities of ingredients, percentages or proportions of materials, reaction conditions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties that are sought by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value however, inherently contains certain errors necessarily resulting from the standard deviation found in their respective testing measurements. Moreover, all ranges disclosed herein are to be understood to encompass any and all subranges subsumed therein. For example, a range of "1 to 10" includes any and all subranges between (and including) the minimum value of 1 and the maximum value of 10, that is, any and all subranges having a minimum value of equal to or greater than 1 and a maximum value of equal to or less than 10, e.g., 5.5 to 10.

It is noted that, as used in this specification and the appended claims, the singular forms "a," "an," and "the," include plural referents unless expressly and unequivocally limited to one referent. Thus, for example, reference to "a handle" includes one, two, three or more handles.

Reference will now be made in detail to certain embodiments of the invention, examples of which are illustrated in the accompanying drawings. While the invention will be described in conjunction with the illustrated embodiments, it will be understood that they are not intended to limit the invention to those embodiments. On the contrary, the invention is intended to cover all alternatives, modifications and equivalents which may be included within the invention as defined by the appended claims.

Figure 1:
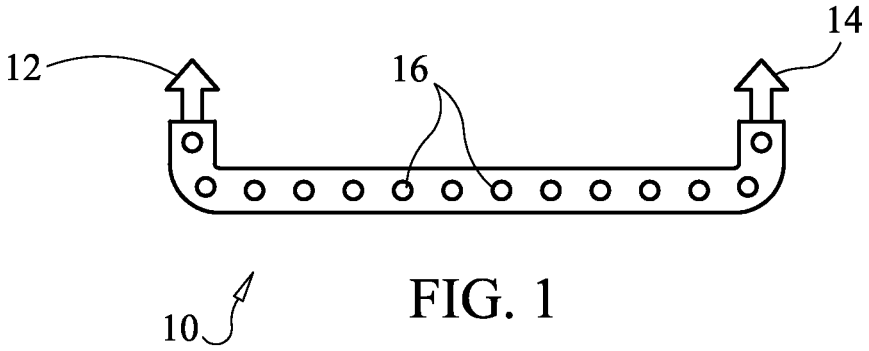
FIG. 1 is a perspective view of an attachable device according to an exemplary embodiment of the present invention.
Figure 2:
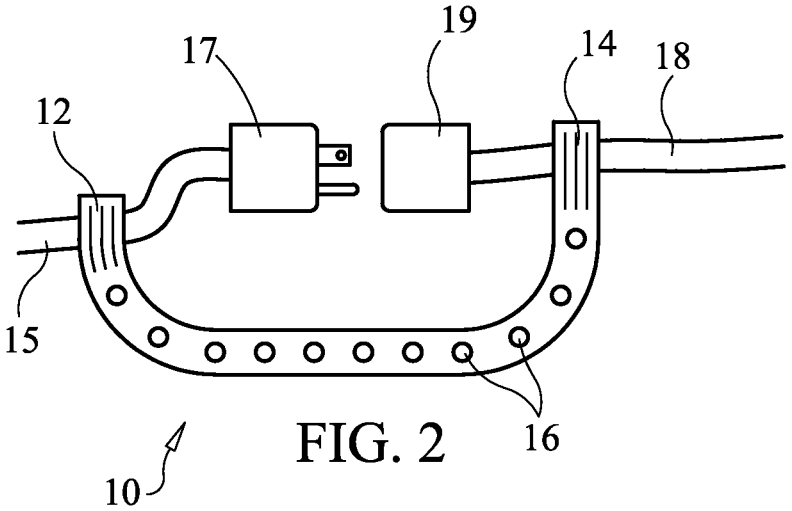
FIG. 2 is a perspective view of the device of FIG. 1 attached to a cord having a male plug and a cord having a female plug wherein the male and female plugs are not connected.
Figure 3:
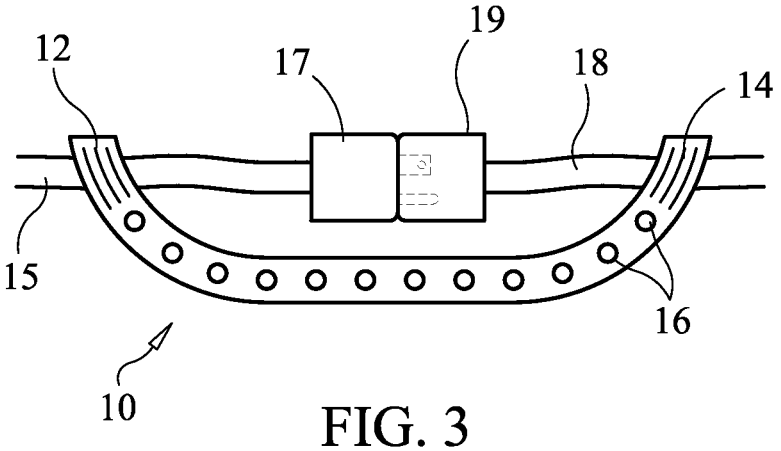
FIG. 3 is a perspective view of the device as shown in FIG. 2 attached to two cords wherein the male and female plugs are connected and the cords are pulled in a direction away from each other.

FIGS. 1-3 illustrate a perspective view of one embodiment of an attachable device 10. As can be seen in FIG. 1, the device 10 has a first connector 12 and a second connector 14. The device 10 also has a plurality of holes 16 for enhancing the flexibility of the device 10. The device 10 attaches via first and second connectors 12 and 14 to a pair of cords coupled together via male and female plugs to prevent disengagement of the male and female plugs.

FIG. 2 shows the device 10 of FIG. 1 attached to a pair of cords 15 and 18. In particular, the first connector 12 is attached to a first cord 15 and the second connector 14 is attached to a second cord 18. The first cord 15 has a male plug 17 and the second cord 18 has a female plug 19. The male and female plugs 17 and 19 are not connected. FIG. 3 further illustrates the device 10 shown in FIGS. 1 and 2. In FIG. 3, the male and female plugs 17 and 19 are connected and the device 10 is shown in a stretched position as the first and second cords 15 and 18 are pulled in a direction away from each other. The device 10 provides strength to the coupling of the male and female plugs 17 and 19 by preventing or minimizing any force on the male and female plugs 17 and 19 to separate when the first and second cords 15 and 18 are pulled in a direction away from each other.

Figure 4:
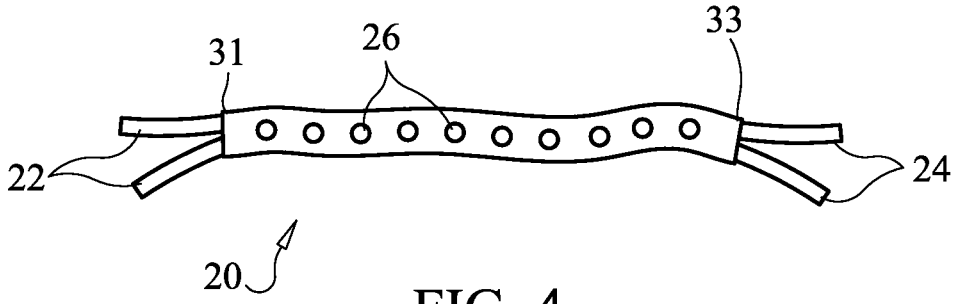
FIG. 4 is a perspective view of an attachable device having a pair of straps at each end according to an exemplary embodiment of the present invention.
Figure 5:
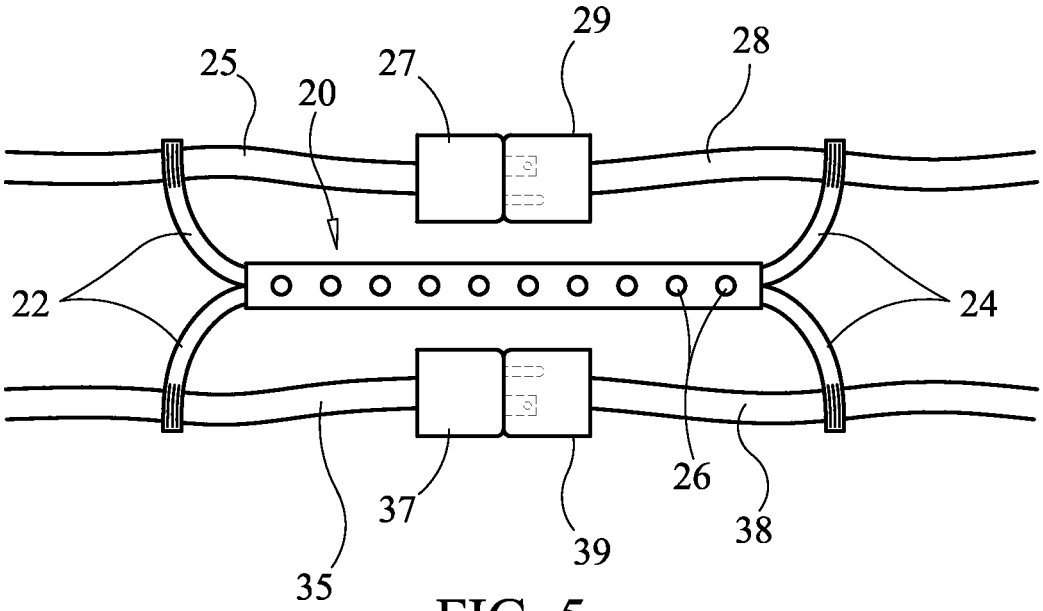
FIG. 5 is a perspective view of the device shown in FIG. 4 attached to a pair of cords coupled together.

FIG. 4 illustrates a perspective view of an embodiment of an attachable device 20 having a first pair of straps 22 at one end 31 and a second pair of straps 24 at a second end 33. The device 20 has a plurality of holes 26 for enhancing the flexibility of the device 20. The device 20 shown in FIG. 4 is shown in FIG. 5 attached to a pair of coupled cords. In particular, one of the first pair of straps 22 is attached to a first cord 25 and one of the second pair of straps 24 is attached to a second cord 28. The first and second cords 25 and 28 are coupled together via first male and female plugs 27 and 29. The other of the first pair of straps 22 is attached to a third cord 35 and the other of the second pair of straps 24 is attached to a fourth cord 38. The third and fourth cords 35 and 38 are coupled together via second male and female plugs 37 and 39. The device 20 provides strength to the coupling of first male and female plugs 27 and 29 and second male and female plugs 37 and 39 and prevents disengagement of these plugs. The device 20 accomplishes this by preventing or minimizing any force on the first male and female plugs 27 and 29 to separate when the first and second cords 25 and 28 are pulled in a direction away from each other. Likewise, the device 20 prevents or minimizes any force on the second male and female plugs 37 and 39 to separate when the third and fourth cords 35 and 38 are pulled in a direction away from each other.

Figure 6:
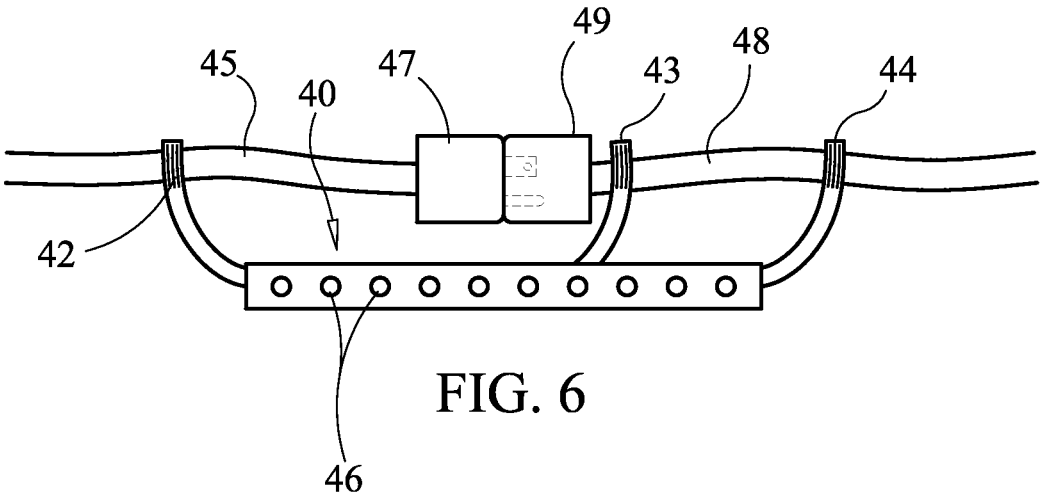
FIG. 6 is a perspective view of a device attached to a pair of cords coupled together via first, second and third straps according to an exemplary embodiment of the present invention.

Another embodiment of an attachable device 40 is shown in FIG. 6. The device 40 has a first strap 42, a second strap 44 and a third strap 43. The first strap 42 is connected to a first cord 45. The second strap 44 and the third strap 43 are both connected to a second cord 48 as shown in FIG. 6. The first and second cords 45 and 48 have male and female plugs 47 and 49 connected together. The device 40 also has a plurality of holes 46 to enhance the flexibility of the device 40. In this embodiment, the device 40 provides additional strength to the coupling of male and female plugs 47 and 49 by preventing or minimizing any force on the male and female plugs 47 and 49 to separate when the first and second cords 45 and 48 are pulled in a direction away from each other. The third strap 43 further prevents or minimizes any force on the male and female plugs 47 and 49 to separate when the first and second cords 45 and 48 are pulled away from each other.

Figure 7:
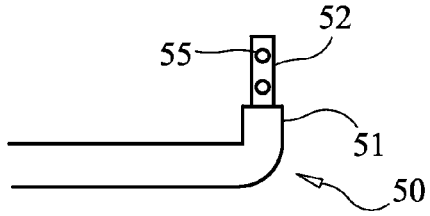
FIG. 7 is a perspective view of one end of an attachable device having a strap with a snap-button fastener.

FIG. 7 shows a perspective view of one end 51 of another embodiment of an attachable device 50. The device 50 has a strap 52 at the end 51. The strap 52 has a snap-button fastener 55 for attachment to a cord (not shown). In alternative embodiments, the strap can include a Velcro-type fastener or other fastening means.

Figure 8:
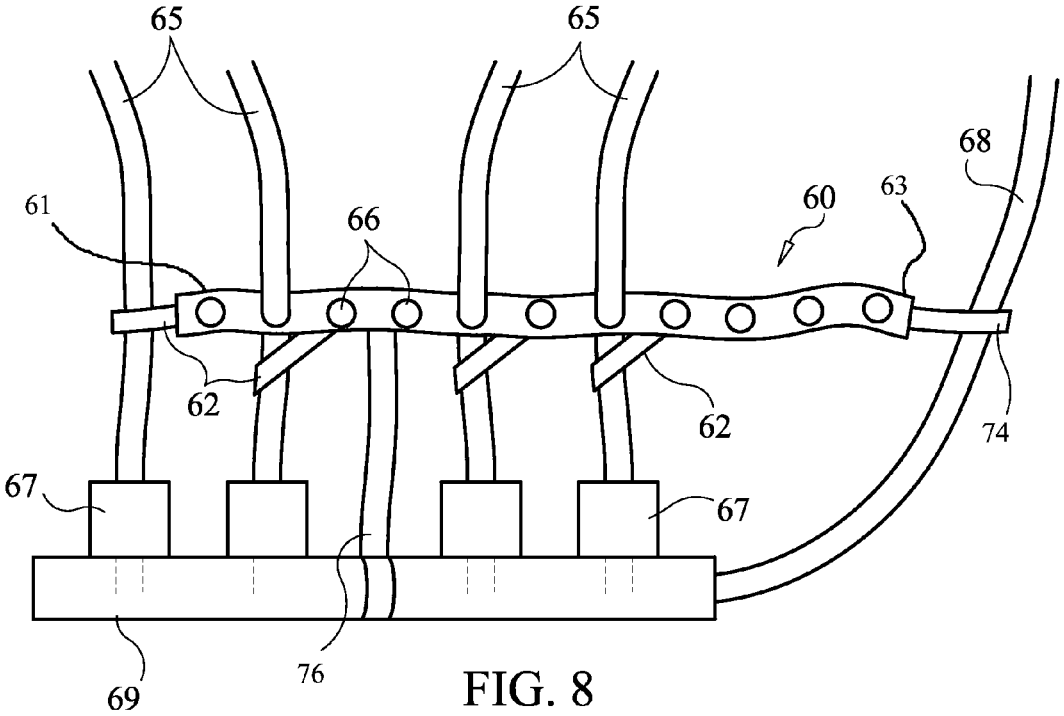
FIG. 8 is a perspective view of a device preventing disengagement of several cords coupled to receptacles on an outlet strip of an extension cord.

FIG. 8 shows another exemplary embodiment of an attachable device 60. The device in FIG. 8 has four straps 62 on one end 61 and a strap 74 on the other end 63. The straps 62 are each connected to cords 65 which are coupled by male plugs 67 to receptacles (not shown) on an outlet strip 69 of extension cord 68. The strap 74 is connected to cord 68. The device 60 also has a plurality of holes 66 to enhance the flexibility of the device 60. In this embodiment, the device 60 provides additional strength to the coupling of male plugs 67 to the receptacles on the outlet strip 69 of extension cord 68 by preventing or minimizing any force on the male plugs 67 and receptacles to separate when any of the cords 65 are pulled in a direction away from the receptacles on the outlet strip 69. In one embodiment, a strap 76 is connected to outlet strip 69 so as to minimize any force on male plugs 67 which may cause male plugs 67 to separate from outlet strip 69.

The devices in various embodiments can be re-used as needed. Further, the devices can be shaped length-wise in the form of a tube, an elongated cylinder, an elongated rectangle, a flat and thin wire, etc. The dimensions of devices can vary depending on the size of the cords that the devices will be attached to. With respect to the length of the devices, in various embodiments, the devices have a length in the range of from about 1 inch to about 60 inches. In some embodiments, the devices have a length in the range of from about 4 inches to about 16 inches.

With respect to the diameter or perimeter across the devices, the dimensions will vary depending upon the shape of the device. In various embodiments having a device in the shape of a tube, the diameter is in the range of from about 0.01 inches to about 5 inches. In some embodiments having a device in the shape of a tube, the diameter is in the range of from about 0.5 inches to about 1 inch. In various embodiments having a device in the shape of an elongated rectangle, the perimeter is in the range of from about 0.5 inches to about 5.0 inches.

In one embodiment, the device is tubular-shaped and has a length of 12 inches with a diameter of 0.5 inches. In another embodiment, the device is tubular-shaped and has a length of 24 inches with a diameter of 1 inch.

In various embodiments, the device may have a plurality of holes to enhance the flexibility of the device. The plurality of holes can be in various shapes and sizes to achieve desired characteristics. For example, the holes can be in form of a square, a circle, a rectangle, an oval, a polygon, a cut, a slit, a rectangular slot or the like. Various shapes and sizes of the holes can enable a desired level of lateral and/or longitudinal flexibility as well as help the various devices described herein absorb any torque or force when cords attached to the various devices are pulled away from each other. The holes can be formed in essentially any known way including but not limited to micro-machining, saw-cutting, laser cutting, casting, molding, chemically etching or treating, or other known methods and the like. In some embodiments, the devices may include combinations of both complete and partial holes through the structure of the device.

The various devices described herein can include a material that is not stretchable or substantially non-stretchable such as one or more of plastic, wood, metal, etc. In some embodiments, the device includes a fabric that is substantially non-stretchable yet flexible such as woven fabrics, sateen, satin, chiffon and the like. In some embodiments, the device includes a non-stretchable material including one or more of polyvinyl chloride, high density polyethylene or rubber.

It will be apparent to those skilled in the art that various modifications and variations can be made to various embodiments described herein without departing from the spirit or scope of the teachings herein. Thus, it is intended that various embodiments cover other modifications and variations of various embodiments within the scope of the present teachings.

What is claimed is:

1. An attachable device for preventing disengagement of a male plug connected to a female plug comprising:

an elongated portion extending along a longitudinal axis between a first end having a first connector extending therefrom and a second end having a second connector extending therefrom, wherein each of said male and female plugs have a cord extending therefrom and the first connector is connected to one of the cords extending from the male and female plugs and the second connector is connected to the other cord such that the device prevents disengagement of the male and female plugs when the cords are pulled in a direction away from each other, wherein the elongated portion is movable between a first configuration in which there is a first distance between the first and second ends along the longitudinal axis and the male and female plugs are spaced apart from one another and a second configuration in which there is an increased second distance between the first and second ends along the longitudinal axis and the male and female plugs engage one another.

2. The device of claim 1, wherein each of the first and second connectors comprise a strap.

3. The device of claim 2, wherein said strap comprises a Velcro-type fastener.

4. The device of claim 2, wherein said strap comprises a snap-button fastener.

5. The device of claim 2, wherein each of the first and second connectors comprise an additional strap for preventing disengagement of a second male plug connected to a second female plug.

6. The device of claim 5, wherein said additional straps comprise a Velcro-type fastener.

7. The device of claim 1, wherein the elongated portion has a third connector at a point between the first and second connectors and the third connector is connected to one of the cords.

8. The device of claim 1, wherein the elongated portion is tubular-shaped, cylindrically-shaped or rectangularly-shaped.

9. The device of claim 8, wherein the elongated portion is tubular-shaped and comprises holes therein.

10. The device of claim 1, wherein the first and second connectors are spaced apart from one another when the elongated portion is in the second configuration.

11. The device of claim 1, wherein:

the first and second connectors are connected to the cords when the elongated portion is in both the first and second configurations; and the male and female plugs are positioned between the first and second ends when the elongated portion is in both the first and second configurations.

12. An attachable device for preventing disengagement of a male plug connected to a female plug comprising:

an elongated tubular portion extending along a longitudinal axis between a first end having a first strap extending therefrom and a second end having a second strap extending therefrom, wherein each of said male and female plugs have a cord extending therefrom and the first strap is connected to one of the cords extending from the male and female plugs and the second strap is connected to the other cord such that the device prevents disengagement of the male and female plugs when the cords are pulled in a direction away from each other, wherein the elongated tubular portion is movable between a first configuration in which there is a first distance between the first and second ends along the longitudinal axis and the male and female plugs are spaced apart from one another and a second configuration in which there is an increased second distance between the first and second ends along the longitudinal axis and the male and female plugs engage one another.

13. The device of claim 12, wherein the elongated tubular portion comprises holes therein.

14. A method for preventing disengagement of a male plug connected to a female plug, each of said male and female plugs having a cord extending therefrom, the method comprising:

providing the device of claim 1, with the elongated portion in the first configuration; and moving the elongated portion from the first configuration to the second configuration.

15. The method of claim 14, wherein each of the first and second connectors comprise a strap.

16. The method of claim 15, wherein said strap comprises a Velcro-type fastener.

17. The method of claim 15, wherein said strap comprises a snap-button fastener.

18. The method of claim 14, wherein each of the first and second connectors comprise an additional strap for preventing disengagement of a second male plug connected to a second female plug.

19. The method of claim 18, wherein said additional straps comprise a Velcro-type fastener.

20. The method of claim 14, wherein the device has a third connector at a point between the first and second connectors and the third connector is connected to one of the cords.

* * * * *